US008584893B2

(12) United States Patent
Durham

(10) Patent No.: US 8,584,893 B2
(45) Date of Patent: Nov. 19, 2013

(54) HANDLED GIFT BOX

(76) Inventor: Stacey Ann Durham, Austin, TX (US)

( * ) Notice: Subject to any disclaimer, the term of this patent is extended or adjusted under 35 U.S.C. 154(b) by 103 days.

(21) Appl. No.: 13/206,303

(22) Filed: Aug. 9, 2011

(65) Prior Publication Data

US 2012/0031919 A1 Feb. 9, 2012

Related U.S. Application Data

(60) Provisional application No. 61/372,026, filed on Aug. 9, 2010.

(51) Int. Cl.
*B65D 25/10* (2006.01)

(52) U.S. Cl.
USPC ..... 220/754; 220/770; 220/772; 383/6; 383/13; 383/16; 383/20; 383/21; 229/116.5; 229/117.17; 229/117.24; 229/117.25; 229/125.18; 229/125.22; 229/922; 206/378; 206/488

(58) Field of Classification Search
USPC ..... 220/754, 770, 772; 229/116.5, 117.17, 229/117.24, 117.25, 125.22; 206/278, 488; 383/6, 13, 16, 20, 21
See application file for complete search history.

(56) References Cited

U.S. PATENT DOCUMENTS 335,777 A * 2/1886 Schaffer et al. ..... 229/117.24
4,008,540 A * 2/1977 Brower ..... 43/55

* cited by examiner

*Primary Examiner* — Anthony Stashick
*Assistant Examiner* — Elizabeth Volz
(74) *Attorney, Agent, or Firm* — Sinorica, LLC

(57) ABSTRACT

A handled gift box has the top inside the bottom, instead of top over bottom; and comprises a box, two handles fixed to the box though handle fasteners, one handle is attached to bottom box and the other is attached to top box and bottom box. Also, since the handled gift box comes either pre-decorated or undecorated, which can be chosen from different combinations of decorations, the gift givers are given the freedom to customize the present invention however they see fit. The handled gift box can be used for, but is not limited to, apparel, picture frames, light food items, books, and other items designed to lay flat in the gift-giving process.

16 Claims, 9 Drawing Sheets

HANDLED GIFT BOX

The current application claims a priority to the U.S. Provisional Patent application Ser. No. 61/372,026 filed on Aug. 9, 2010.

FIELD OF THE INVENTION

The present invention relates generally to gift wrapping. It is the object of the present invention to provide a way to transport and carry gifts without having them become damaged or ruined.

BACKGROUND OF THE INVENTION

Presently, there are not many options of gift wrapping other than a simple gift box or a decorated gift bag. There are advantages to either design. A gift box is structured in its design and as a result, it is useful to hold gifts that need to be laid flat or gifts such as, but not limited to, apparel. On the other hand, a gift bag is beneficial because it comes already decorated for the special occasion and has straps which can be used to easily transport the gift. The present invention, the handled gift box, is a combination of both of these types of gift giving. It not only provides the structure and security of a gift box, but also the portability of a gift bag. The present invention also creates a more versatile method of gift giving with its changeable decorative themes and wide range of usable materials.

DETAIL DESCRIPTIONS OF THE INVENTION

All illustrations of the drawings are for the purpose of describing selected versions of the present invention and are not intended to limit the scope of the present invention.

Presently, a gift box is used mostly for apparel or for items that need to be laid flat instead of upright. This is because gift boxes have a structured shape, similar to that of any other ordinary box, making it an easy and safe choice to hold gifts. A gift box allows items like apparel to lay undisturbed. Apparel is often wrapped in a gift box because many clothes cannot be placed upright in a gift bag without the problem of it becoming damaged or wrinkled, which would make the gift un-presentable. A disadvantage to the gift box is that a gift box is simply just that, a box, and it does not have a method of handling other than being held in one's arms. Unlike a gift box, a traditional gift bag, which is another common method of gift wrap, is easy to transport. Items simply need to be placed inside the gift bag and the entire process of gift wrapping is already completed. Unlike with gift boxes, gift bags come already decorated and ready to gift. The set of handles on a gift bag helps to make it easier to transport because they are capable of being hand held rather than its counterpart, the gift box. The present invention, the handled gift box, combines both a traditional gift box and a traditional gift bag into one product that makes use of the benefits of both previous designs. The handled gift box is essentially a gift box with handles similar to that of a traditional gift bag. Therefore, it has the preferred structure of a gift box with the ease of portability of a gift bag. Similar to the gift bag, the present invention also comes fully decorated and ready for use. The unique aspect about the handled gift box is that the entire invention is customizable to the user's needs. The decoration themes can change, which makes the present invention a highly reusable and money saving product.

Figure 1:
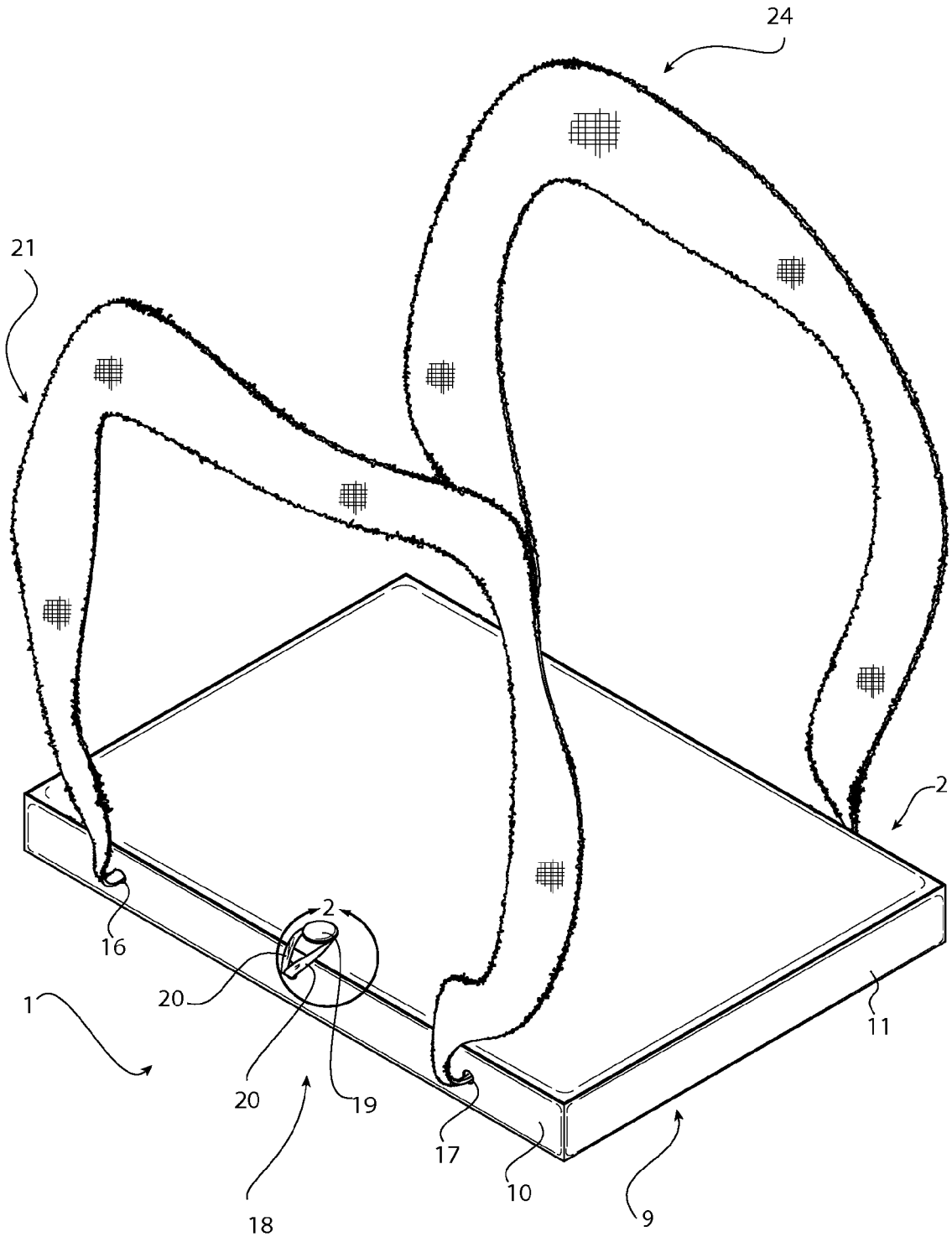
FIG. 1 is a perspective view of the present invention in which a detail view is taken and shown in FIG. 2.
Figure 2:
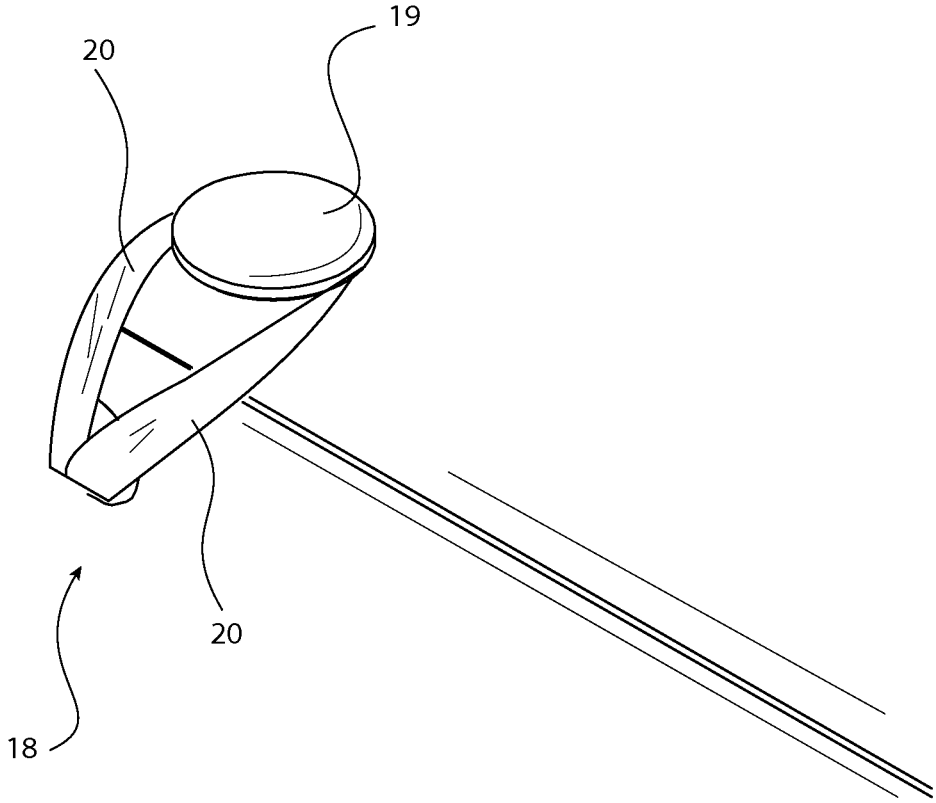
FIG. 2 is a detail view of the closure mechanism. The diagram shows the components and mechanisms involved with the closure mechanism.
Figure 3:
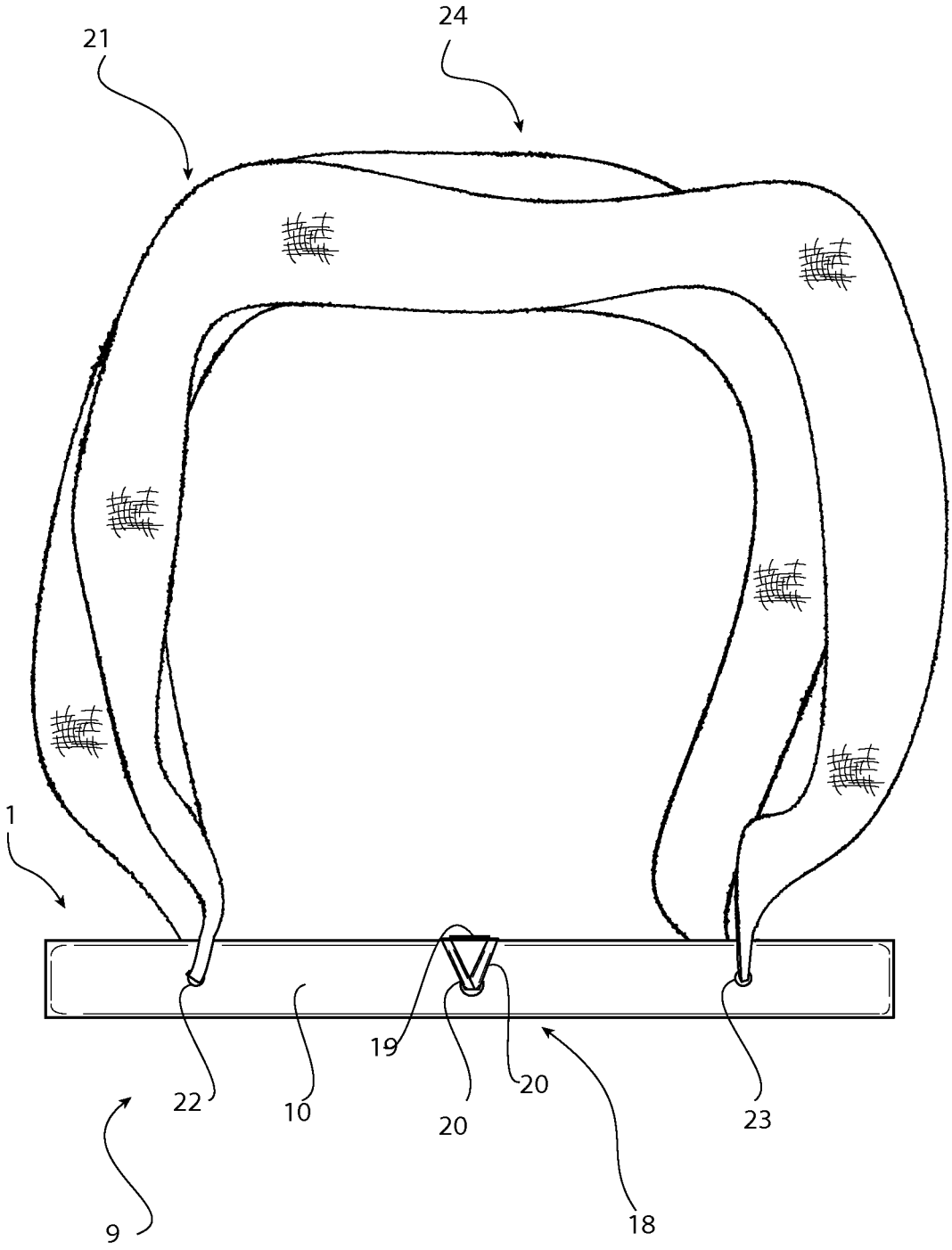
FIG. 3 is a front plan view of the present invention.
Figure 4:
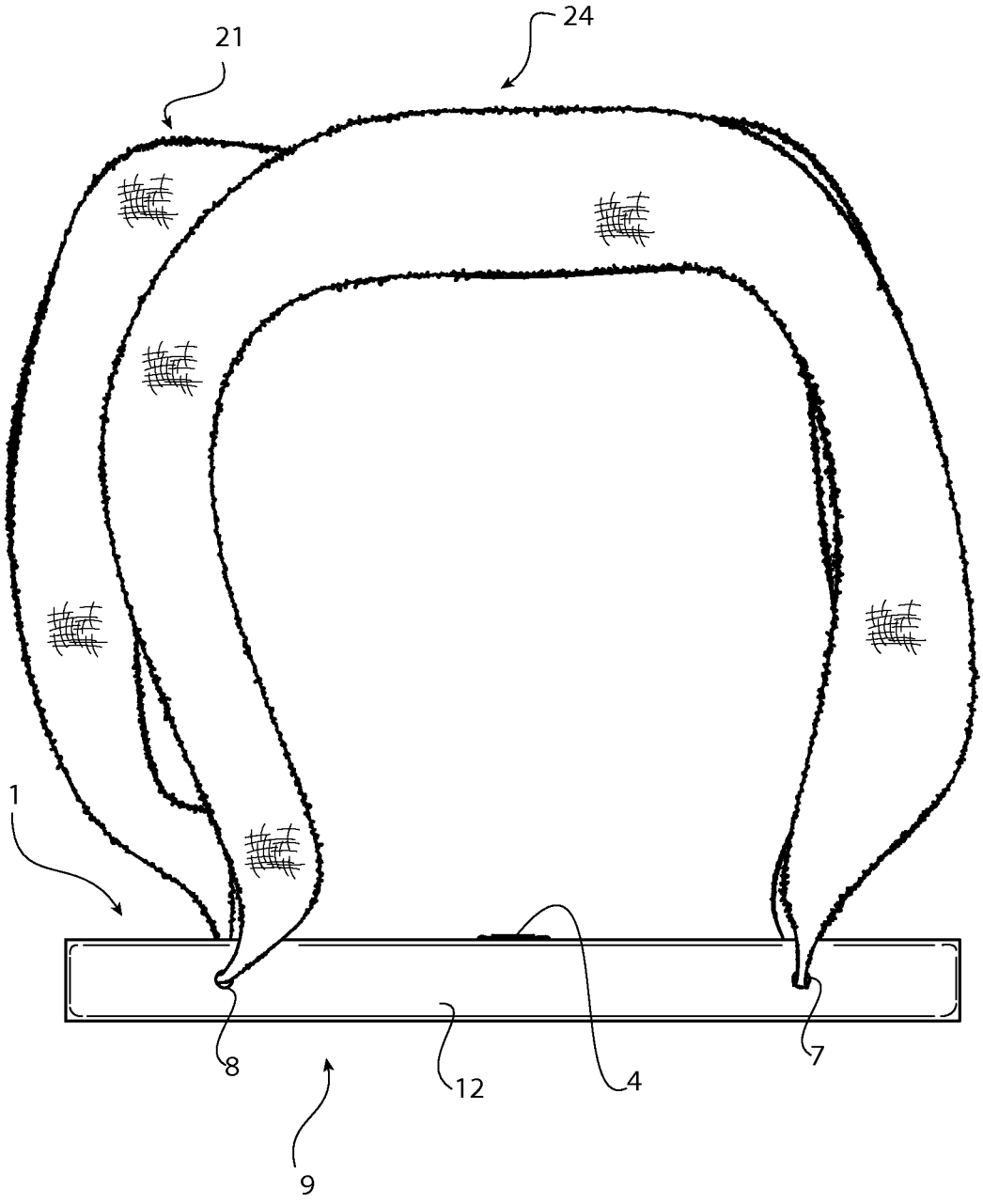
FIG. 4 is a back plan view of the present invention.
Figure 5:
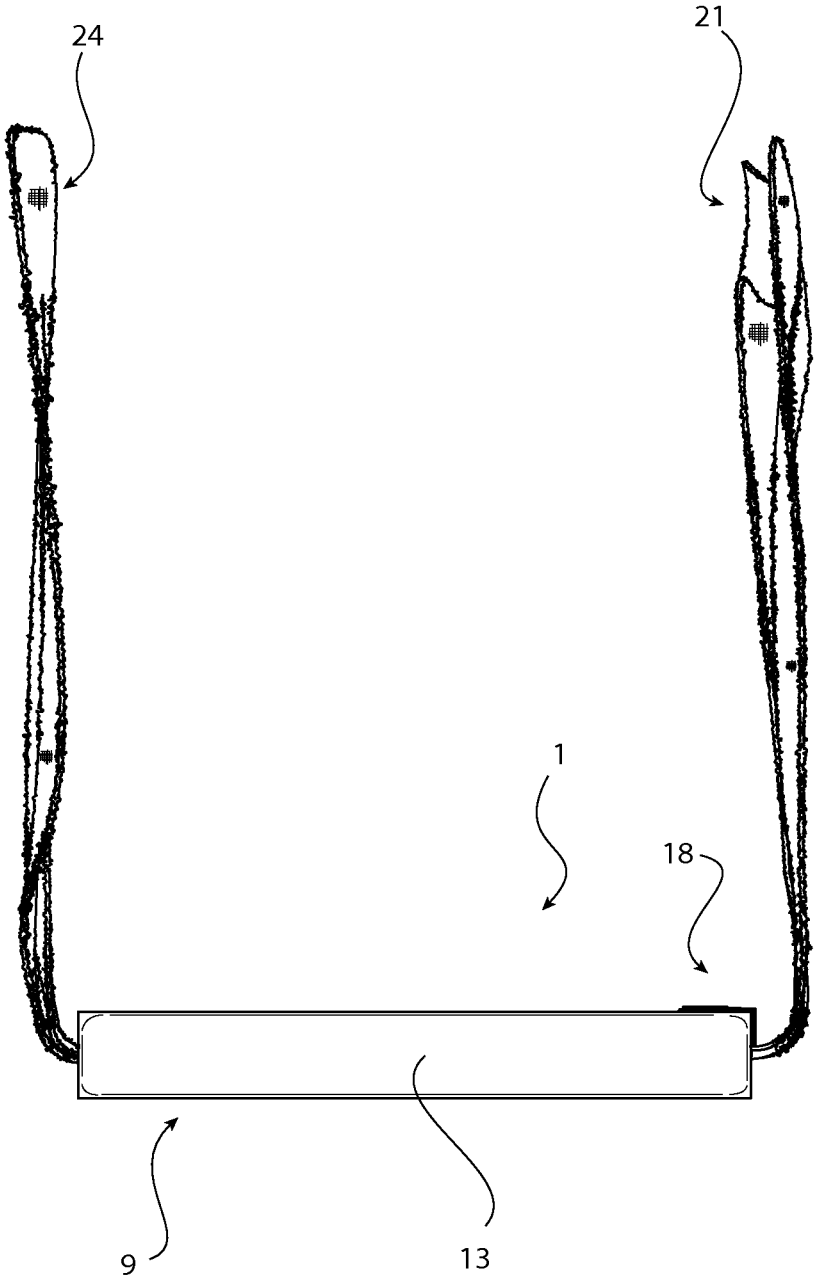
FIG. 5 is a left side view of the present invention.
Figure 6:
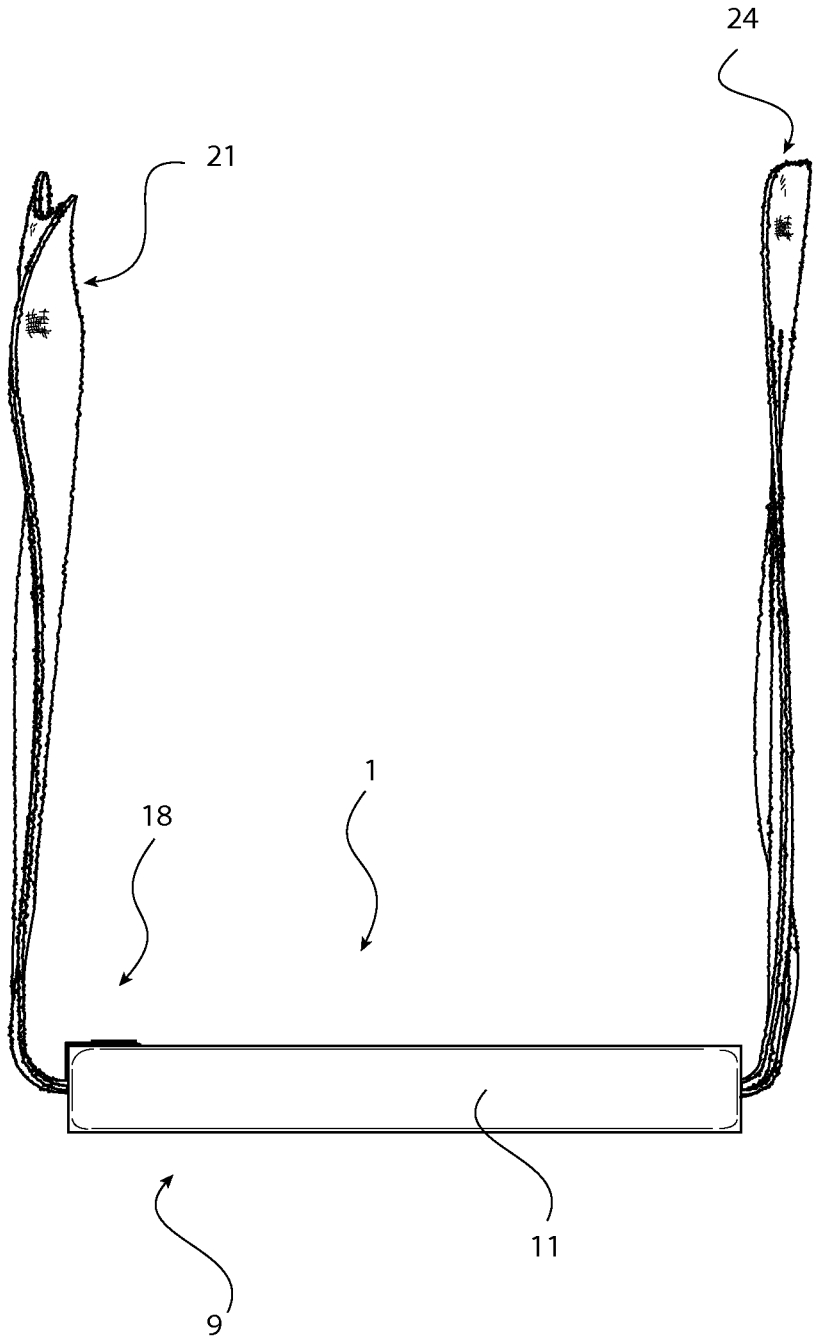
FIG. 6 is a right side view of the present invention.
Figure 7:
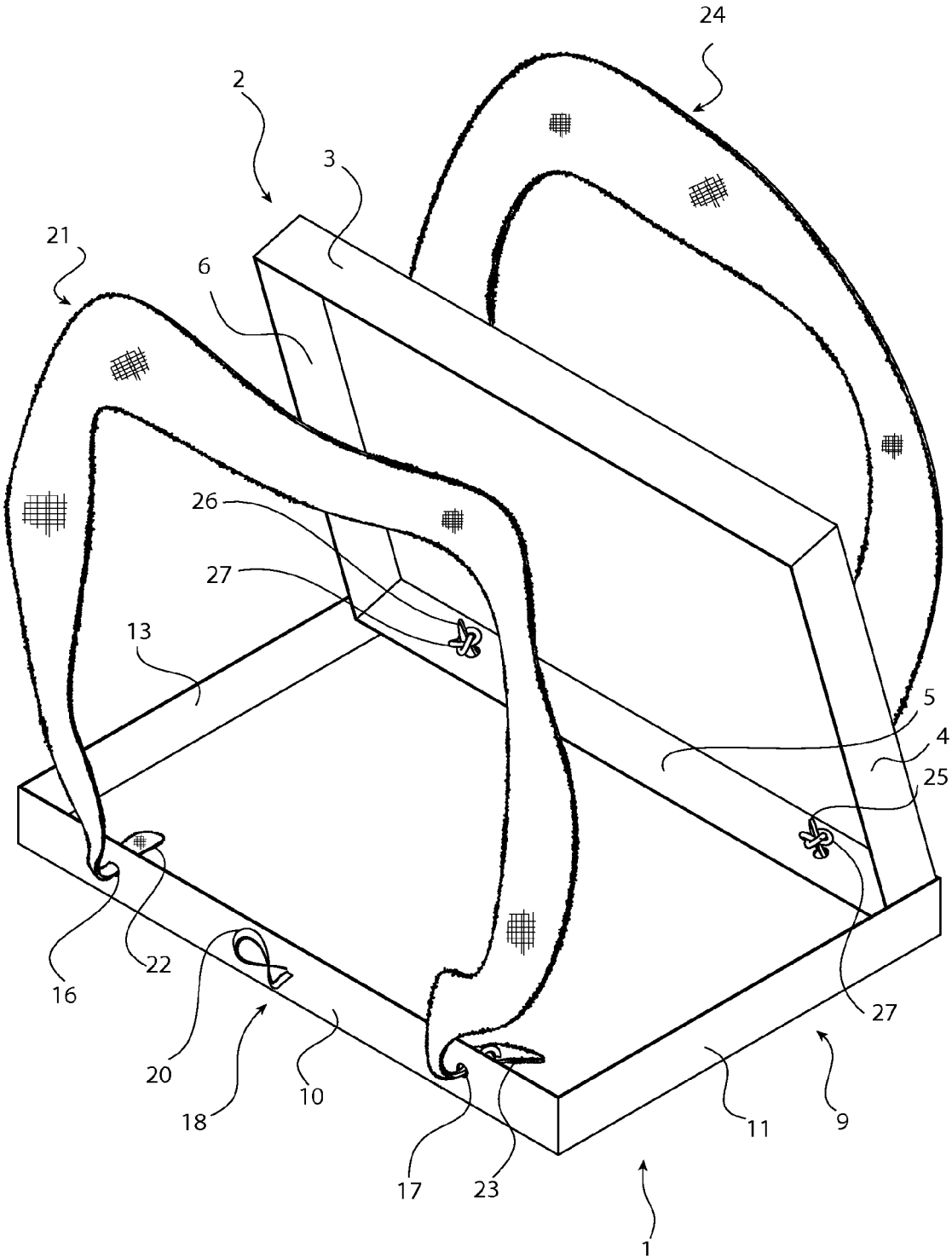
FIG. 7 is a perspective view of the present invention while it is open.
Figure 8:
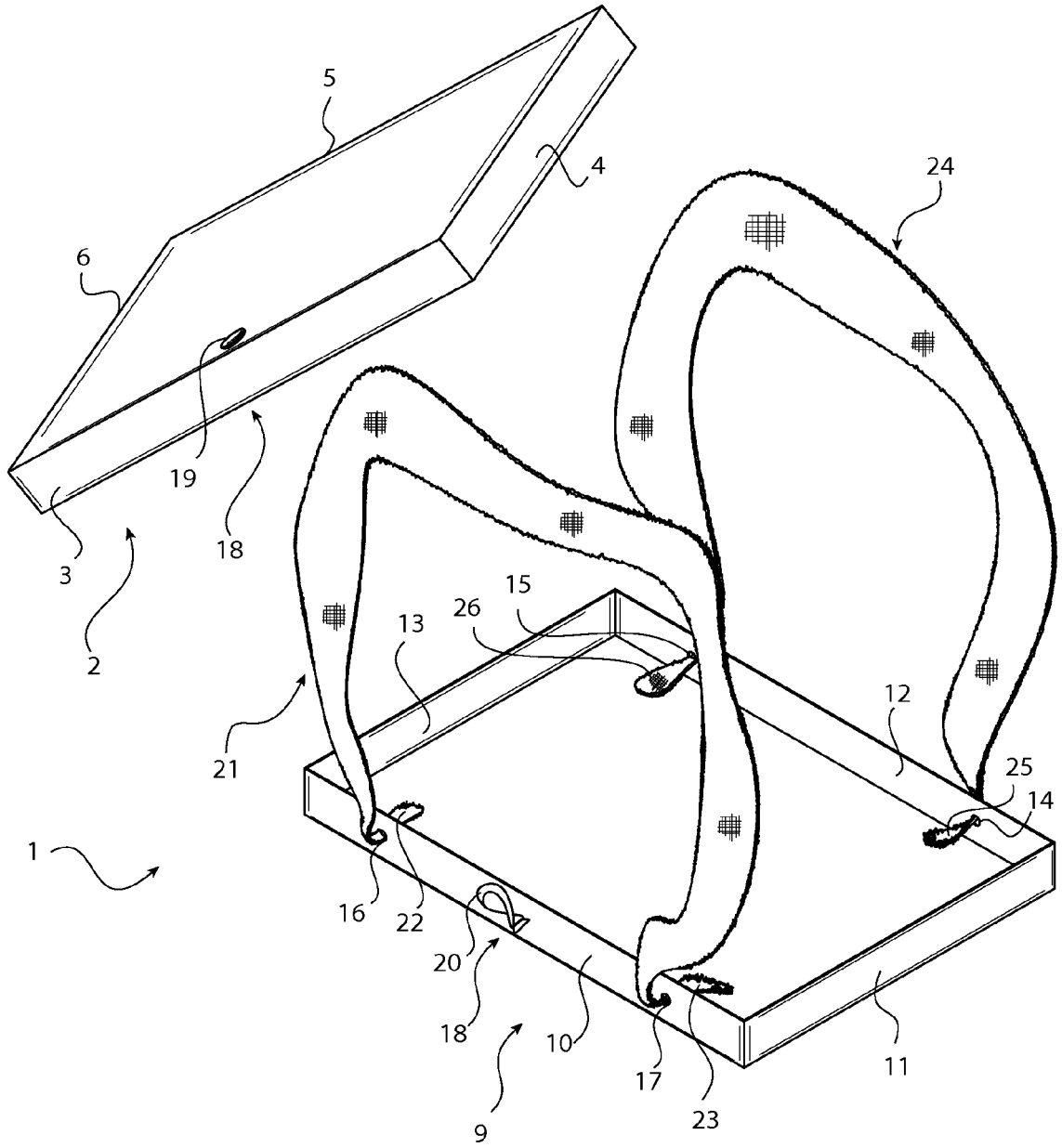
FIG. 8 is a disassembled perspective view of the present invention.

In references to FIG. 1, FIG. 7, and FIG. 8, the handled gift box is comprised of a box 1, a front handle 21, a back handle 24, and a plurality of handle fasteners 27. The box 1 is the component that houses the gift. Both the front handle 21 and the back handle 24 help to transport the box 1 while the plurality of handle fasteners 27 help to keep the front handle 21 and the back handle 24 in place.

Referring to FIG. 1, FIG. 2, FIG. 3, FIG. 4, FIG. 5, FIG. 6, FIG. 7, and FIG. 8 the box 1 comprises of a top box 2, a bottom box 9, and a closure mechanism 18. The box 1 itself can be of any shape or size. For example, traditional gift boxes are often rectangular shaped as opposed to the handled gift box, which can come in the traditional rectangle shape but also can be a square box or even a cylindrical box. It is up to the customer to decide which shape and size handled gift box he or she desires. The convenience of the box 1, and as a result the handled gift box, is that despite its variety in structure, the components will remain the same and connect the same. Also, there are a wide range of materials that can be used to construct the box 1. Currently, the preferred material is, but not limited to, cardboard. Another convenience of the box is that the top box 2 and the bottom box 9 can be opened easily to gain access to the gift inside. This is because the top box 2 is smaller in size than the bottom box 9. As a result, the top box 2 is able to fit inside the bottom box 9. Also, box 1 is inverted when compared to a traditional gift box. This is so the top box 2 will be able to lift upwards to open and act as a lid that can open and close easily. This is helpful because in traditional gift boxes, the components of the gift box (the top and bottom) have to be pulled apart, which sometimes does not happen easily because the components are tightly fitted together. Therefore, when attempting to open the gift box, the user can easily jostle the gift box which could damage the items inside. The handled gift box, because of its inverted shape, is easy to open to allow the user easy access to its contents, without worrying about potential damage.

In reference to FIG. 4, FIG. 5, FIG. 6, FIG. 7 and FIG. 8, the top box 2 comprises of a top front panel 3, a top right panel 4, a top back panel 5, a top left panel 6, a back handle top left hole 7, and a back handle top right hole 8. On the other hand, the bottom box 9 comprises of a bottom front panel 10, a bottom right panel 11, a bottom back panel 12, a bottom left panel 13, a back handle bottom left hole 14, a back handle bottom right hole 15, a front handle bottom left hole 16, a front handle bottom right hole 17. The top box 2 is an open box in which its bottom surface is missing. The bottom box 9 is also very similar where it is missing its top surface. When the top box 2 and the bottom box 9 are aligned with each other, their missing surfaces meet. The lack of surfaces helps to ensure that there is enough room for the gift inside of the box 1. Essentially, the top front panel 3 will align with the bottom front panel 10. Then, the top right panel 4 will align with the bottom right panel 11. The top back panel will align with the bottom back panel 12, and the top left panel 6 will align with the bottom left panel 13. When all the panels of the top box 2 align with the bottom box 9, the holes on each of them will also align. For instance, the back handle top left hole 7 will align with the back handle bottom left hole 14, the back handle top right hole 8 will align with the back handle bottom right hole. The front handle left hole 16 and front handle right hole 17, both located on the bottom box 9, do not align with any holes on the top box 2. The alignment of the panels and the holes on the top box 2 and the bottom box 9 will ensure that the box 1 will be properly constructed. Without proper construction, the handled gift box will not be able to complete its full capacity in purpose and function. Also, none of the aforementioned holes are restricted in their shape. All holes may be circular, as the word holes usually implies, but they could also be square or triangles, or even simple slits that are large enough so the front handle 21 and back handle 24 are able to loop through all of them.

Another convenience of the handled gift box is that it will be fully finished for the user. Often times, users have to pay extra money to obtain nice gift wrapping for their gift boxes because gift boxes are usually undecorated and plain. Many people who do not pay to get their boxes gift wrapped will resort to gift wrapping the boxes themselves, which can become a struggle for those who do not particularly enjoy gift wrapping. There will be no need to gift wrap the handled gift box as is the case with traditional gift boxes. The handled gift box will come already decorated and wrapped for the specific occasion as needed. The decorations needed for each handled gift box can be sold separately as well, allowing the customer to decide exactly how the handled gift box will look. This alleviates the hassle often associated with gift wrapping.

In reference to FIG. 1, FIG. 3, FIG. 4, FIG. 5, FIG. 7, and FIG. 8 the components that add convenience to the handled gift box are the front handle 21 and back handle 24. Often times, ordinary gift boxes are difficult to carry because of their size as well as their potential weight. The front handle 21 and back handle 24 ensure that it is easy to lift gifts, without the need to bend over and raise them from the ground or table surface, which can potentially strain one's back. The front handle 21 is comprised of a left front handle end 22 and a right front handle end 23. The left front handle end 22 will loop through the front handle left hole 16 while the right front handle end 23 will loop through the front handle right hole 17. The front handle 21, as its name suggests, is for the front of the box 1. The handled gift box's versatility allows the box's 1 designated front to be whatever panel the user chooses. The back handle 24 comprises of a left back handle end 25 and a right back handle end 26. Similar to the front handle 21, the left back handle end 25 loops through both the back handle top left hole 7 and the back handle bottom left hole 14. The right back handle end 26 loops through the back handle top right hole 8 and the back handle bottom right hole 15. Also, the connection between the top box 2 and the bottom box 9, which was created with the back handle 24 and the plurality of fasteners 27, can resemble a hinge joint that helps to ensure that the box 1 remains closed. It adds another element of protection that will help keep the gift from being damaged or mishandled.

Also referring to FIG. 1, the front handle 21 and back handle 24 also provide different methods of carrying the gift. The present invention can be carried in one's hands, on an arm, or on a shoulder. The different methods of carrying the handled gift box are appealing to people who might have trouble carrying the box 1 in their hands. The front handle 21 and back handle 24 are a convenient way to transport the box 1, especially when needing to carry multiple gifts at one time. For instance, aside from birthdays and other individual celebrations, many other occasions which call for gifts require that gifts be given to multiple people, often at the same time. This means that the gift giver must carry multiple gifts with them at the same time, which can become a difficult task when the gifts have to be stacked atop each other because they lack a method of carrying. Being able to hold and transport the gifts in their hands makes holding multiple gifts much easier to handle and carry. Similar to the box's 1 variety, both the front handle 21 and the back handle 24, can also vary in size, shape, design and material. Essentially, the front handle 21 and back handle 24 need only be as simple as twine. However, to add to the aesthetic nature of gifts, the front handle 21 and the back handle 24 can be made of, but are not limited to, ribbon, yarn, lace, cords, wires. The only requirement for the material of the front handle 21 and the back handle 24 is that it needs to be able to withstand the weight of the box. Otherwise, it is up to the user to decide which material he or she desires. The handled gift box is a completely customizable gift and as such, the front handle 21 and the back handle 24 can be made of a variety of materials.

Referring to FIG. 7 and FIG. 8, another main component of the handled gift box is the plurality of handle fasteners 27. Designed to be attached to the front handle 21 and back handle 24, the plurality of handle fasteners 27 are used to secure each connection between the front handle 21 and back handle 24 to the box 1. The plurality of handle fasteners 27 act as stoppers that prevent left front handle end 22 and the right front handle end 23 from falling out of the front handle left hole 16 and the front handle right hole 17, respectively, and detaching from the box 1. Similarly, the handle fasteners 27 help to prevent the left back handle end 25 from falling out of the back handle top left hole 7 and the back handle bottom left hole 14. The same can be said for the right back handle end 26 and its ability to maintain being looped through the back handle top right hole 8 and the back handle bottom right hole 15, simply because of the handle fasteners 27. The front handle 21 and back handle 24 both need to be kept attached to the box 1 because if they were able to come loose from the box 1, the box 1 itself would not only come apart midst carrying, but also, the contents would be damaged, and as a result, defeat the purpose of the entire present invention.

In references to FIG. 7 and FIG. 8, a variety of materials can be used for the handle fasteners 27. The handle fasteners 27 can be made of, but are not limited to, washers or even premade knots that simply can be tightened around the left front handle end 22, the right front handle end 23, the left back handle end 25, and the right back handle end 26. Also, another option for the handle fasteners 27 is to simply to connect either ends of each handle together. For instance, the left front handle end 22 can be tied to the right front handle end 23 on the inside of the bottom front panel 10. Similarly, the left back handle end 25 and the right back handle end 26 can be tied to each other on the inside of the top back panel 5 and bottom back panel 12.

Figure 9:
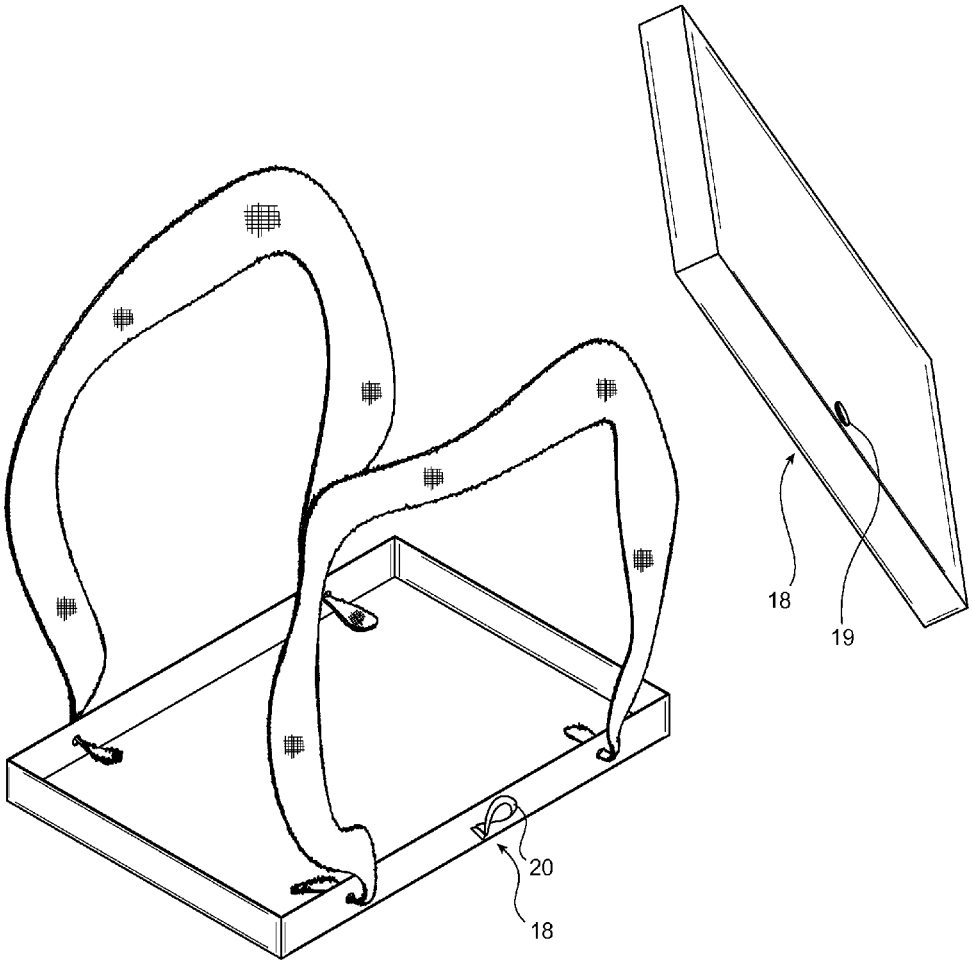
FIG. 9 is a disassembled perspective view illustrating the second closure mechanism.

In references to FIG. 1, FIG. 2, FIG. 3, and FIG. 8, the closure mechanism 18 is used to keep the box 1 closed when needed. The closure mechanism 18 comprises only of a female part 19 and a male part 20. It needs only to ensure that the top box 2 does not detach from the bottom box 9 unless the user wishes for it to happen. The male part 20 is inserted onto the female part 19 to secure the closure mechanism 18. The male part 20 can be positioned on either the bottom front panel 10, the top front panel 3, the bottom right panel 11, or the top right panel 4. Similarly, the female part 19 can be positioned on the top front panel 3, bottom front panel 10, the top right panel 4, or the bottom right panel 11, respectively. The location of the female part 19 corresponds to the location of the male part 20. Therefore, if the male part 20 was placed on the bottom front panel 10, the female part 19 would be placed on the top front panel 3. If the male counterpart 20 was instead placed on the top front panel 3, the female part 19 would subsequently be placed on the bottom top panel 10. Another instance would be if the male part 20 was positioned on the bottom right panel 11 or the top right panel 4, which would then require the female part 19 to be located on either the top right panel 4 or the bottom right panel 11, respectively. The closing mechanism 18 can be made up of, but is not limited to, eyelets, snap buttons, a button and loop pair, a hook and tab pair, or even a string that can be looped around a disk. The interaction between the female part 19 and the male part 20 will keep top box 2 from moving or opening from the bottom box 9. The closure mechanism 18 is a precautionary measure that is designed to keep the items inside of the handled gift box free from damage. Without the closure mechanism 18, the top box 2 has the possibility of separating from the bottom box 9 while being held by it's the front handle 21 and back handle 24, which would then cause the handled gift box to fall apart. Consequently, the gift would then be ruined. Presently, there is only one closure mechanism 18 located on the top front panel 3 and bottom front panel 10 and comprises of a button for the female part 19 and a loop for the male part 20. The male part 20 is attached through a hole on the bottom box 9 whereas the female part is attached through a hole on the top box 2. Another location where a second closure mechanism 18 can be used is on the top back panel 5 and the bottom back panel 12. Basically, the first and second closure mechanisms are structurally identical. The second closure mechanism is illustrated in FIG. 9 as item 18. This will help ensure that the top back panel and the bottom back panel remain closed together. This second closure mechanism 18 would eliminate the need for the previously mentioned hinge joint that was created from the back handle 24 and the fasteners 27.

To again add to the previously mentioned versatility of the handled gift box, the present invention can also be reused. While it comes with extra decorative items such as tissue paper, which is commonly used to wrap the gift before it is placed in box 1, many of the decorations can even be reused. The user who receives the gift will be able to change the decorations of the handled gift box to fit his or her needs. This increases the usefulness of the present invention as well, because the handled gift box can now be reused continually. In most cases, decorated gift boxes and gift bags cannot be redecorated with a different theme (i.e. birthday or a wedding), which leads to the gifted box or bag to be thrown out. This is not only inconvenient because the user now has to go find a method of gift wrap, but it is also wasting material that does not need to be thrown away. The present invention, allows for the user to easily change themes and reuse what was once gifted to him or her.

Although the invention has been explained in relation to its preferred embodiment, it is to be understood that many other possible modifications and variations can be made without departing from the spirit and scope of the invention as hereinafter claimed.

What is claimed is:

1. A handled gift box comprises, a box;

a front handle;

a back handle;

said front handle not being connected to back handle directly;

a plurality of handle fasteners;

the box comprises of a top box, a bottom box, and a closure mechanism;

the top box being positioned inside the bottom box;

the front handle being attached to the bottom box;

the back handle being attached to the top box and bottom box;

the front handle comprises of a left front handle end and a right front handle end;

the back handle comprises of a left back handle end and a right back handle end;

said front handle ends not being connected to said back handle ends;

the plurality of handle fasteners securing both the front handle and the back handle to the box;

the closure mechanism comprises of a female part and a male part; and the closure mechanism being positioned on the top box and bottom box.

2. The handled gift box as claimed in claim 1 comprises, the left front handle end being positioned through the front handle left hole;

the right front handle end being positioned through the front handle right hole;

the left back handle being positioned through the back handle bottom left hole and back handle top left hole; and the right back handle being positioned through the back handle bottom right hole and back handle top right hole, wherein the back handle hinges the top back panel and bottom back together.

3. The handled gift box as claimed in claim 1 comprises, the female part being positioned on either top front panel, bottom front panel, top right panel, or bottom right panel; and the male part being positioned on either bottom front panel, the top front panel, bottom right panel, or the top right panel.

4. The handled gift box as claimed in claim 1 comprises, the top box comprises of a top front panel, a top right panel, a top back panel, a top left panel, a back handle top left hole, and a back handle top right hole; and the bottom box comprises of a bottom front panel, a bottom right panel, a bottom back panel, a bottom left panel, a front handle left hole, a front handle right hole, a back handle bottom left hole, and a back handle bottom right hole.

5. The handled gift box as claimed in claim 4 comprises, the top front panel being aligned with the bottom front panel;

the top right panel being aligned with the bottom right panel;

the top back panel being aligned with the bottom back panel; and the top left panel being aligned with the bottom left panel.

6. The handled gift box as claimed in claim 4 comprises, the back handle top left hole being aligned with the back handle bottom left hole;

the back handle top right hole being aligned with the back handle bottom right hole;

the front handle left hole being traversed through either the bottom front panel or bottom right panel;

the front handle right hole being traversed through either the bottom front panel or bottom right panel;

the back handle top left hole being traversed through the either top back panel or top left panel;

the back handle top right hole being traversed through either top back panel or top left panel;

the back handle bottom left hole being traversed through either the bottom back panel or bottom right panel; and the back handle bottom right hole being traversed through either the bottom back panel or bottom right panel.

7. A handled gift box comprises, a box;

a front handle;

a back handle;

said front handle not being connected to back handle directly;

a plurality of handle fasteners; and the box comprises of a top box, a bottom box, a plurality of closure mechanisms the front handle being attached to the bottom box;

the back handle being attached to the top box and bottom box; and the top box being positioned inside the bottom box;

the front handle comprises of a left front handle end and a right front handle end;

the back handle comprises of a left back handle end and a right back handle end;

said front handle ends not being connected to said back handle ends;

the plurality of handle fasteners securing both the front handle and the back handle to the box;

the plurality of closure mechanisms having a first closure mechanism and a second closure mechanism;

the closure mechanism comprises of a female part and a male part; and the closure mechanism being positioned on the top box and bottom box.

8. The handled gift box as claimed in claim 7 comprises, the left front handle end being positioned through the front handle left hole;

the right front handle end being positioned through the front handle right hole;

the left back handle being positioned through the back handle bottom left hole; and the right back handle being positioned through the back handle bottom right hole.

9. The handled gift box as claimed in claim 7 comprises, the first closure mechanism being positioned on either the top front panel, the bottom front panel, the top right panel, or the bottom right panel;

the second closure mechanism being positioned on the top back panel, the bottom back panel, the top left panel, or the bottom left panel;

each closure mechanism comprises of a female part and a male part;

the male part being secured onto the female part;

the female part of the first closure mechanism being positioned on either top front panel, bottom front panel, top right panel, or bottom right panel;

the male part of the first closure mechanism being positioned on either bottom front panel, the top front panel, bottom right panel, or the top right panel;

the female part of the second closure mechanism being positioned on either the top back panel, the bottom back panel, the top left panel, or the bottom left panel; and the male part of the second closure mechanism being positioned on either the bottom back panel, the top back panel, the bottom left panel, or the top left panel.

10. The handled gift box as claimed in claim 7 comprises, the top box comprises of a top front panel, a top right panel, a top back panel, a top left panel, a back handle top left hole, and a back handle top right hole; and the bottom box comprises of a bottom front panel, a bottom right panel, a bottom back panel, a bottom left panel, a front handle left hole, a front handle right hole, a back handle bottom left hole, and a back handle bottom right hole.

11. The handled gift box as claimed in claim 10 comprises, the top front panel being aligned with the bottom front panel;

the top right panel being aligned with the bottom right panel;

the top back panel being aligned with the bottom back panel; and the top left panel being aligned with the bottom left panel.

12. The handled gift box as claimed in claim 10 comprises, the back handle top left hole being aligned with the back handle bottom left hole;

the back handle top right hole being aligned with the back handle bottom right hole;

the front handle left hole being traversed through either the bottom front panel or bottom right panel;

the front handle right hole being traversed through either the bottom front panel or bottom right panel;

the back handle top left hole being traversed through the either top back panel or top left panel;

the back handle top right hole being traversed through either top back panel or top left panel;

the back handle bottom left hole being traversed through either the bottom back panel or bottom right panel; and the back handle bottom right hole being traversed through either the bottom back panel or bottom right panel.

13. A handled gift box comprises, a box;

a front handle;

a back handle;

said front handle not being connected to back handle directly;

a plurality of handle fasteners;

the box comprises of a top box, a bottom box, and a closure mechanism;

the top box being positioned inside the bottom box;

the front handle being attached to the bottom box;

the back handle being attached to the top box and bottom box;

the plurality of handle fasteners securing both the front handle and the back handle to the box;

the closure mechanism being positioned on the top box and bottom box;

the closure mechanism comprises of a female part and a male part;

the front handle comprises of a left front handle end and a right front handle end;

the back handle comprises of a left back handle end and a right back handle end;

said front handle ends not being connected to said back handle ends;

the top box comprises of a top front panel, a top right panel, a top back panel, a top left panel, a back handle top left hole, and a back handle top right hole; and the bottom box comprises of a bottom front panel, a bottom right panel, a bottom back panel, a bottom left panel, a front handle left hole, a front handle right hole, a back handle bottom left hole, and a back handle bottom right hole.

14. The handled gift box as claimed in claim 13 comprises, the top front panel being aligned with the bottom front panel;

the top right panel being aligned with the bottom right panel;

the top back panel being aligned with the bottom back panel;

the top left panel being aligned with the bottom left panel;

the back handle top left hole being aligned with the back handle bottom left hole; and the back handle top right hole being aligned with the back handle bottom right hole.

15. The handled gift box as claimed in claim 13 comprises, the front handle left hole being traversed through either the bottom front panel or bottom right panel;

the front handle right hole being traversed through either the bottom front panel or bottom right panel;

the back handle top left hole being traversed through the either top back panel or top left panel;

the back handle top right hole being traversed through either top back panel or top left panel;

the back handle bottom left hole being traversed through either the bottom back panel or bottom right panel;

the back handle bottom right hole being traversed through either the bottom back panel or bottom right panel;

the left front handle end being positioned through the front handle left hole; and the right front handle end being positioned through the front handle right hole.

16. The handled gift box as claimed in claim 13 comprises, the left back handle being positioned through the back handle bottom left hole and back handle top left hole;

the right back handle being positioned through the back handle bottom right hole and back handle top right hole, wherein the back handle hinges the top back panel and bottom back together;

the female part being positioned on either top front panel, bottom front panel, top right panel, or bottom right panel; and the male part being positioned on either bottom front panel, the top front panel, bottom right panel, or the top right panel.

* * * * *